US006168337B1

(12) United States Patent
Adams

(10) Patent No.: US 6,168,337 B1
(45) Date of Patent: Jan. 2, 2001

(54) FLATTENABLE LOOP BINDER

(76) Inventor: F. Kendall Adams, 16193 Interlachen Blvd., Lakeville, MN (US) 55044

( * ) Notice: Under 35 U.S.C. 154(b), the term of this patent shall be extended for 0 days.

(21) Appl. No.: 09/243,759

(22) Filed: Feb. 3, 1999

(51) Int. Cl.[7] ..... B42F 3/00

(52) U.S. Cl. ..... 402/8; 402/70; 402/73; 402/75; 402/13; 402/60; 402/68; 24/16 PB; 24/153 R; 24/206

(58) Field of Search ..... 402/70, 73, 75, 402/8, 13, 60, 68; 24/153 R, 16 PB, 206

(56) References Cited

U.S. PATENT DOCUMENTS

| | | | | |
|---|---|---|---|---|
| 212,061 | * | 2/1879 | Smith | 402/70 |
| 2,329,786 | * | 9/1943 | Ringler | 129/41 |
| 2,495,180 | | 1/1950 | Phillips . | |
| 2,595,427 | | 5/1952 | Trussell . | |
| 2,612,166 | * | 9/1952 | Trussell | 129/1 |
| 2,910,068 | | 10/1959 | Lane . | |
| 3,077,887 | | 2/1963 | Levitan . | |
| 3,313,303 | | 4/1967 | Beyer . | |
| 3,433,688 | * | 3/1969 | Staats et al. | 156/85 |
| 3,956,798 | * | 5/1976 | Wright | 24/153 R |
| 5,888,011 | * | 3/1999 | Reinbold, Jr. | 402/70 |

OTHER PUBLICATIONS

Sketch of old check stub storage cover from Delux Check Corp., 1985.

* cited by examiner

*Primary Examiner*—Willmon Fridie, Jr.
*Assistant Examiner*—Daniel Phan
(74) *Attorney, Agent, or Firm*—R. C. Baker & Associates, Ltd.

(57) ABSTRACT

The pliable, readily flattenable loop binder for retaining loose-leaf sheets has a mounting strip with an elongated spine, an adhesive on the back of the spine, and a removable liner over the adhesive. Paired transversely aligned loop-forming elements project outward from opposing longitudinal edges of the spine. Off one edge are pliable and readily bendable straps. Off the other edge are strap receivers. The strap of a pair is threaded through a punched hole of punched paper and drawn over the spine and then threaded through its receiver so that the back surface of the strap faces the back surface of the receiver. Each loop formed by a pair of loop-forming elements is teardrop in contour and is flattenable toward the front surface of the spine with a single folded bend in said strap. Locking structures on straps engage the receivers to resist shifting of straps in their receivers. Spacers are used to space the loop binder from and align it parallel to the dominant crease or fold of an ordinary folder when converting the folder to a loop binder folder.

19 Claims, 2 Drawing Sheets

FLATTENABLE LOOP BINDER

BACKGROUND OF THE INVENTION

This invention relates to a flattenable loop binder for retaining loose-leaf sheets, and particularly to a simple strip structure useful to convert an ordinary file folder into a loop binder folder. The invention also relates to loop binder folders formed incorporating principles of the invention and to methods of using the new binder principles of the invention.

Heretofore, the prior art has directed itself to the formation of ring binders that are far too stiff to be collapsible or flattenable. For the most part, such ring binders either form the backbone or have been affixed to the backbone of a folder having a front cover hinged to one side of the backbone and a back cover hinged to the other side, much the same as the front and back covers of a book are hinged to opposite sides of a backbone to which the pages of a book are attached. These ring binders are essentially precluded from being flattened even if attempted. They are far too stiff, even fracturable.

Further, insofar as is known, even when ring binders have been mounted near the inner edge of the back cover of a folder, they have not been designed to be flattenable. The principle of a strip hinged to a back cover carrying a ring binder and also hinged to a front cover on its opposite side remains the standard procedure for known back cover mounted binders, presumably because the binders are stiff and totally impractical to flatten under ordinary use conditions, and even may be fractured on any attempt to flatten.

Equally significant to the above is the fact that the ring binders as heretofore known are astonishingly sophisticated and frequently too sophisticated and expensive for the mass of uses involving but a few loose-leaf sheets as in many sales folders, pricing folders, business proposals of a preliminary nature, and a multitude of other uses where a thick volume of loose-leaf paper is not required and is indeed undesirable, especially when it comes to storage, whether the storage is in a briefcase or other carrying case or in any file cabinet.

BRIEF SUMMARY OF THE INVENTION

This invention directs itself to simple loose-leaf binding that facilitates easy optional collapse of the binder structure on folding the front and back cover of a folder equipped with the new binder. This new loop binder reduces the thickness of a folder equipped with it (as compared to known ring binder folders) and thus reduces the space occupied by the folder in a brief case or in a file cabinet or in otherwise handling and storing it. The new binder is pliable and readily flattenable.

A key feature of the new binder is that it has a mounting strip, and the dominant essence of this strip is its elongated spine. The spine has opposing longitudinal edges which define the transverse width of the spine. For convenience, one of the longitudinal edges is suitably called a strap edge and the other a receiver edge.

Loop-forming elements project outward from the opposing longitudinal edges of the spine, and these loop-forming elements are in a paired transversely aligned relationship. Pliable and readily bendable loop-forming straps project outward from the strap edge of the spine, and flexible strap receivers project outward from the receiver edge of the spine.

The relationship between the straps and the receivers is the epitome of simplicity. Formation of a loop involves threading a strap through its transversely aligned receiver in a manner that causes the end of the strap to project outward from the spine and the back of the straps to face the back of the receiver. The loop is easily flattened, and in doing so, a single fold is formed in the strap. The fold in the strap is off the strap edge of the spine.

For the purpose of enhancing the formation of loops of equal size, the loop-forming straps are preferably equipped with a locking structure for engagement with the strap receivers on the opposite edge of the spine; and the locking structure for each strap is ideally at an equally distant location from the strap edge of the spine so that, once each locking structure engages its strap receiver, teardrop loops of equal size will be formed.

The manner of affixing the spine of a mounting strip to the back cover of a folder near the dominant crease or fold of the folder is preferably by adhesion, whether effected by fusion or by employing a special material as an adhesive. The preferred structure of the invention employs a pressure-sensitive adhesive. Ideally, the pressure-sensitive adhesive is coated on the back surface of the spine and then, if the spine is not immediately secured to the back cover of a folder, a low adhesion protective removable liner is temporarily applied over the outer surface of the pressure-sensitive adhesive layer.

For the purpose of orienting a mounting strip having a spine and adhesive layer in an ideally spaced relationship from and parallel to the dominant crease of a folder, special spacer elements are preferably provided.

Many other advantageous and highly desired features for the new loop binder, and for folders employing it, as well as the method or process of using it, will be evident from the further description and details to follow.

DETAILED DESCRIPTION OF THE INVENTION

Figure 1:
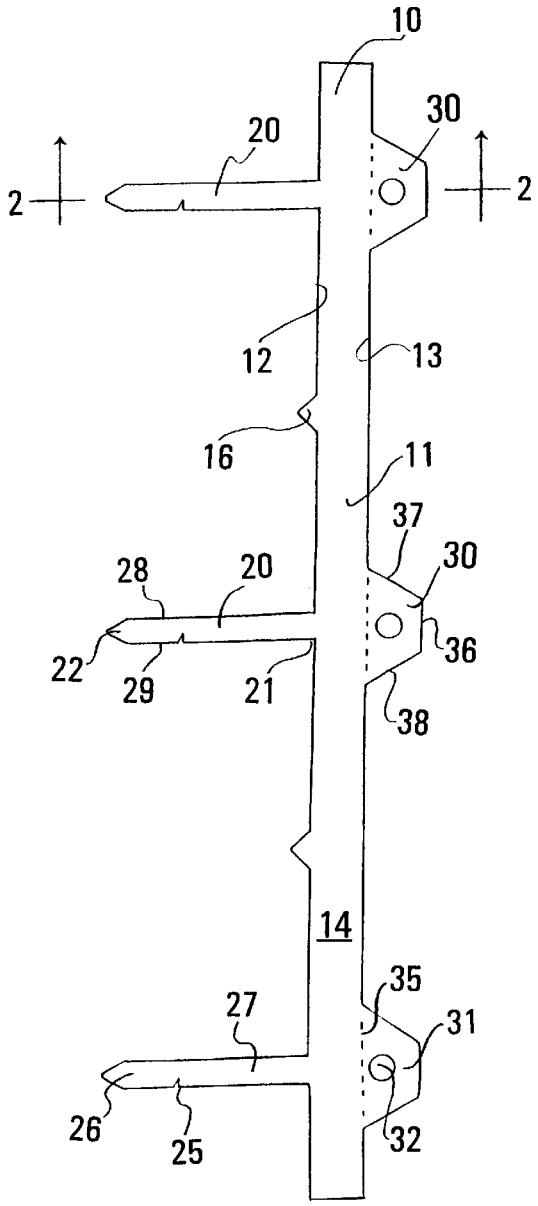
FIG. 1 is a flat plane view of a loop binder of the invention, having an elongated mounting strip spine and paired transversely aligned loop-forming elements.

The same number is given to parts or features in all views of the drawing. For quick orientation, the elements illustrated in FIGS. 1 and 2 of the drawing will first be explained.

A basic feature of the mounting strip 10 is its elongated spine 11. The spine has to be flat when used in a folder equipped with the new loop binder of this invention, but the spine and the entire mounting strip may be coiled as marketed in commerce. The spine has opposing longitudinal edges 12, 13, and front 14 and back 15 surfaces. The longitudinal edges 12, 13 define the transverse width of the spine. One longitudinal edge is called a strap edge 12 and the other is called a receiver edge 13. One or more spacer structures 16 suitably extend outward from the strap edge and serve for easy measuring to space the strap edge of the spine from a dominant crease line or dominant fold line of a file folder or the like, as will hereinafter be further explained. The preferred mounting strips are equipped with an adhesive coating 17 on the back surface of the elongated spine and, where the adhesive is pressure sensitive or is sticky, a low-adhesion and easily removable protective liner 18 is ideally temporarily fixed over the layer of adhesive until the time comes for fixing the loop binder of the invention in a folder for loop-binding use.

The elongated spine 11 is the anchor point or base structure from which loop-forming elements 20, 30 project outward. The loop-forming elements are in pairs, and each pair is transversely aligned in outward projection from the opposing longitudinal edges of the spine. A pair of loop-forming elements is formed by a strap 20 projecting outward from the strap edge 12 and by a strap receiver 30 projecting outward from the receiver edge 13.

Straps 20 are pliable and readily bendable and readily collapsible when in loop form. Their pliability and easy bendability can be compared to the pliability and easy bendability of a leather sheet ranging from kidskin to calf leather, depending on the thickness and the particular material one chooses for the straps 20. (Generally the thickness and particular material will be uniform in a sheet forming the straps, spine, and receivers.) The straps have an end 21 connected to the strap edge 12 and an opposite end extending as a free end 22 and terminating suitably in a blunt point or curvature for easy threading through a receiver 30, specifically through a receiver hole 32. The front surface 23 of the straps extends as a surface from the front surface of the spine, and the back surface 24 of the straps extends as a surface from the back surface of the spine. (Where the straps and receivers are attached to the spine by fusion or some related means, the plane of the surface extensions may have a slight bump. Normally the spine, straps, and receivers are cut from a uniformly thick sheet, and no such bump or deviation will be present.) The opposing lateral edges 28, 29 of the straps define the width of the straps, and the lateral edges should be uniform and define a uniform width throughout the entire length of the straps, or at least a uniform width from the strap edge 12 through to an optional locking structure 25.

Figure 3:
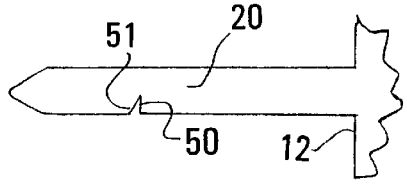
FIGS. 3 and 4 are enlarged flat plan views of straps and their locking structures, with other elements broken away.
Figure 4:
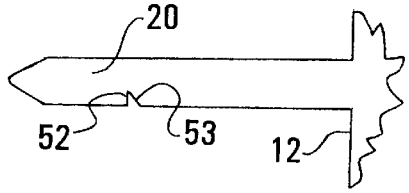

Locking structures 25 on straps are preferred and serve the beneficial function of holding straps at a predetermined degree of penetration through a strap receiver. They do this by engaging strap receivers, as at hole 32, in a manner that resists forward and backward movement of a strap through the strap receiver, but nevertheless allows the option of such movement of a strap further in or out of the strap receiver by simple finger pushing or pulling whenever desired (e.g., as when additional loose-leaf sheets are to be added or subtracted, and optionally also when loops are flattened during closure of a folder containing the binder hereof). An exceedingly useful locking structure for this purpose is one formed by a niche or notch or indentation 25 on a lateral edge of a strap. A suitable niche is formed by intersecting orthogonal 50 and angular 51 edge cuts as shown in FIG. 3, with the orthogonal edge cut 50 nearer the strap edge of the spine than the angular edge cut 51; but the reverse of the orthogonal and angular edge cuts is also useful as shown in FIG. 4 and is more preferred. In FIG. 4, the orthogonal cut 52 is more distant from the strap edge than the angular cut 53. The merit of the style in FIG. 3 lies in the fact that, when the orthogonal edge cut 50 is nearest the strap edge 12, it serves to provide high resistance to strap movement through the strap receiver 30 beyond the locking structure, and the angular cut 51 furthest from the strap edge contributes to easy pulling of the strap out of the strap receiver for removal or addition of loose-leaf sheets. On the other hand, when the angular cut 53 is nearest the strap edge of the spine (as in FIG. 4), the strap easily slides into a locking position or locking engagement position with the strap receiver and the strap is more resistant to being pulled out of the receiver (but nevertheless is quite capable of being pulled out for the addition and removal of loose-leaf sheets). Further, any pressure to press the strap 20 further through the strap receiver 30 has lesser resistance against the strap going further through the receiver when the angular cut is nearest the strap edge, which is preferred and facilitates convenient collapse of the strap to a flattened condition. The significant point is that the straight edge of the orthogonal cut most distant from the strap edge serves as a modest stop member resisting pulling of the strap out of the strap receiver as loose-leaf sheets are turned over in the loops of the binder, and the angular cut easily allows further penetration of a strap through its receiver when flattening of the structure is desired. A variety of other notch or indentation shapes quite different from those illustrated in FIGS. 3 and 4 may be used, including V-shapes, and U-shapes, or other cut shapes.

Importantly, at least one set of locking structures 25 should be spaced from the strap edge 12 of the spine a uniform distance for all of the straps. This set of locking structures can be called the dominant set. In general, the distance from the spine for the dominant locking structure on a strap will be at least about two and up to about three times (possibly even up to four times) the transverse width of the spine. This distance can readily be appreciated as being significant inasmuch as the loop formed by the straps is formed in most instances solely by the portion of the strap between the locking structure and the strap edge of the spine. The portion of the strap between its locking structure and its free end is called the lead end 26, and the portion between the locking structure and the connected end of the strap (i.e., the end connected to the strap edge of the spine) is called the strap body section 27. It will be evident that the locking structure on all straps is at a location more proximate or closer to the free end 22 than to the connected end 21 of the straps.

Generally, only one set of locking structures will be employed (e.g., one per strap), but the option exists to include one or more subordinate sets, if desired. The spacing of any set from the strap edge 12 should be uniform so as to facilitate the formation of equally sized loops for the binder.

Strap receivers 30 project outward from the receiver edge of the spine; their front surface 33 extends from the front surface of the spine and their back surface 34 extends from the back surface of the spine. Ideally, the simplest of strap receivers can be a flange 31 that forms a hole 32 proximate to and laterally outward from the receiver edge 13 of the spine. (Dash lines of scoring 35 define the line of the receiver edge at the flanges.) The hole 32 that functions so as to receive a strap must not lie within the width of the spine, for if it did, it would not be easily flexed upward a slight amount (e.g., preferably no more than 30 or 40 degrees from the plane of the spine) for easy entrainment of the lead end 26 of the strap through it.

Figure 2:
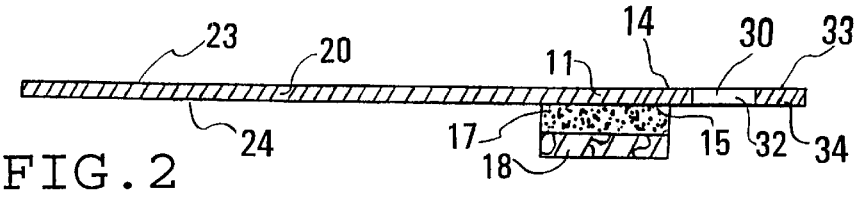
FIG. 2 is an enlarged sectional view taken on line 2—2 of FIG. 1 and particularly illustrates the mounting strip made up of a spine, an adhesive layer or coating, and low-adhesion removable protective liner.

As illustrated in FIG. 1, the flange containing the strap-receiving hole 32 ideally may be shaped with an outer edge 36 and opposing angular lateral edges 37, 38; but the option exists for a continuous flange with a strap receiver hole at the transverse alignment position for each strap. Whatever type of flange is used to form receiving holes, the important point is that it is never flexed upward into a 90 degree relationship with the spine 11. It is always more planar with than perpendicular to the spine, and flexing the flange material upward from the plane of the spine to thread a strap into a receiver hole should not cause more than about a 30 degree or possibly about 40 degree angle for the receiver flange from the plane of the spine. Score lines 35 can be used to weaken the material to contribute to easier flexing upward.

If desired, holes that are not entirely surrounded by flange material may be formed by having a slit access thereinto (such as from, for example, the outer edge of a flange). But there is a disadvantage to the use of holes having a slit access or similar access entry from the edge of the flange. Weakness is created by the slit and lowers the ability of the hole to hold a strap against accidental excessive forward or rearward movement beyond a locking structure after loose-leaf papers have been positioned on loops of the loop binder. Thus, a strap-receiver hole that is completely surrounded by flange material defining the hole is highly preferred.

Figure 5:
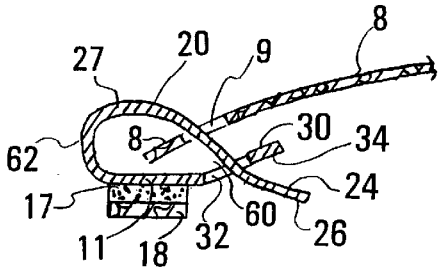
FIG. 5 is an enlarged highly schematic (or diagrammatic) view of the elements of FIG. 2 but with the strap and strap receiver parts connected to form a teardrop loop holding a loose-leaf sheet.

As evident from the schematic of FIG. 5, the loop formed by a pair of loop-forming elements of the invention is quite different from any loop or ring that has heretofore been formed insofar as is known. The strap 20 of a loop-forming element has its free end 22 drawn over the front surface 14 of the width of the spine 11 and then threaded through punched hole 9 of sheets 8 and then through the receiver hole 32 to exit at the back surface 34 of the receiver flange. Generally the exit is to a sufficient extent to cause a locking structure 25 of the strap to engage the receiver hole 32. The result is that the body section 27 of the strap arches over the spine 11 and the lead end section 26 of the strap extends outward from the receiver edge of the spine. This creates a teardrop shape for the loop formed by the body section 27, with the point end 60 of the teardrop formed by the intersection of the strap 20 with the receiver 30 (e.g., at the engagement of the locking structure with the receiver hole 32) and with the balloon end 62 of the teardrop in an opposing relationship (i.e., with the balloon 62 of the teardrop extending slightly outward from the strap edge of the spine), as illustrated in FIG. 5. The spine 11 itself can be looked upon as a side of the over-all teardrop shape or contour.

Figure 6:
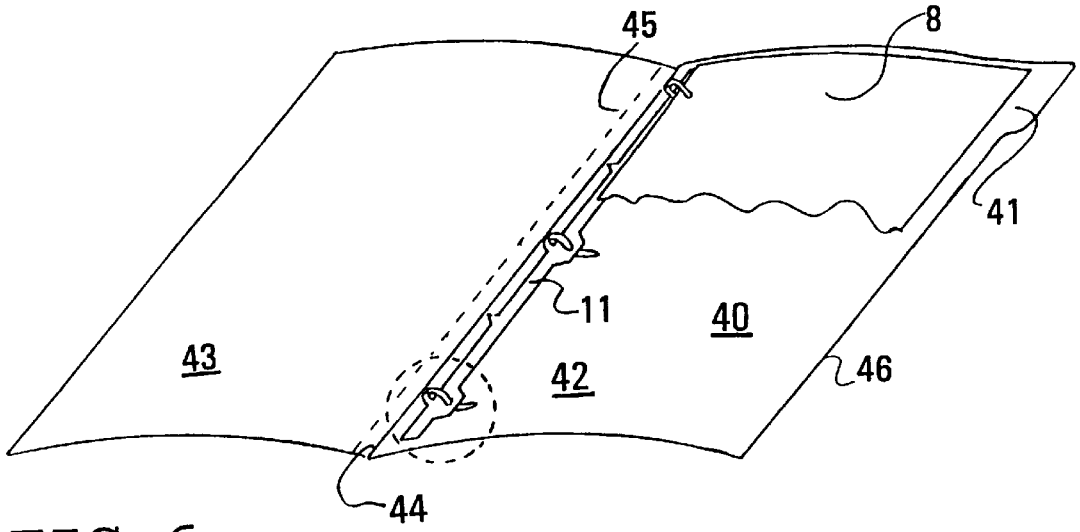
FIG. 6 is a schematic perspective view illustrating a folder equipped with the new loop binder of the invention (mounted on the folder back cover), with all aspects of the drawing made using skeleton lines.
Figure 7:
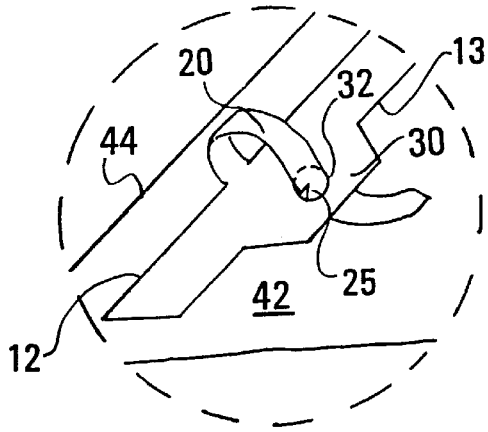
FIG. 7 is an enlargement of the schematic perspective loop within the dashed line circle of FIG. 6.

Just to illustrate the utter simplicity of a loop binder folder achieved by practicing the invention, attention is directed to FIG. 6 as a showing of such a folder 40. Illustratively, the binder folder can be formed using a manilla paper file folder of popular office use. (Manilla paper is known to be somewhat strong and durable and has a brownish or buff color with a smooth finish, originally having been made from manilla hemp.) The significant point is that a useful loop binder folder (regardless of the sheet material of the folder per se) can be utterly simple in structure, with front cover 43 and back cover 42 formed by folding a single sheet of material at a fold line 44. Any folder having a front and back cover may be employed for the practice of the invention; but the manilla file folder 40 with a tab 41 is taken as an illustration of probably the simplest file folder for conversion to a loop binder folder according to this invention.

Useful folders always have a fold line 44, and for convenience in terms of definition, that fold line is the inner edge or "hinge" edge of the back cover 42 of the folder. We can call that fold line the main or dominant fold line. Frequently, manufacturers will score other optional fold lines 45 at increments of space from that main fold line and parallel to it, so as to allow an extra fold once the bulk of paper in the folder has increased to a half centimeter or half inch or full centimeter or full inch, etc. Even if some of these optional fold lines have been prefolded by the manufacturer of the folder, but become useful only after the paper in the file has bulked or increased beyond a certain amount such as a half centimeter or a half inch, etc., the fundamental nature of the folder always is that of having a dominant fold line at the inner edge of the back cover of the folder. (Either cover may be taken as a back cover in terms of the discussion herein.)

Figure 8:
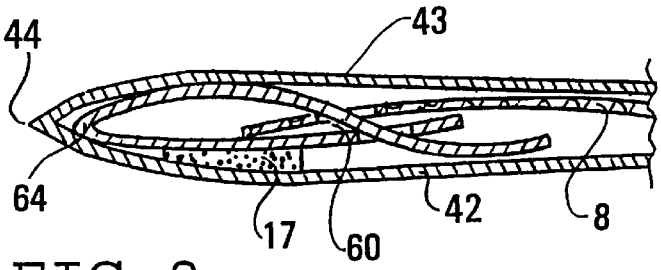
FIG. 8 is a schematic cross-section through a folder and shows a binder loop of the invention in flattened form (with punched sheets in it) as a result of folding the front cover over the back cover of the folder.

The loop binder of the present invention is affixed to the back cover 42. The spine of the binder is ideally positioned on the back cover in a parallel relationship to the dominant fold line or crease 44 located at the inner edge of the back cover, and preferably is positioned on the back cover 42 in a predetermined spaced relationship from that fold line so as to allow space on the back cover side of the dominant fold line 44 for a collapsed or flattened loop strap 20 on folding the front cover 43 of the folder to the back cover. The space may vary, but ideally is great enough to place the strap fold or bend 64 (see FIG. 8) at a location substantially entirely non-overlapping with the dominant fold line 44 when the loop is flattened.

For convenience in establishing ideal spacing of the spine from the dominant fold line of a folder, spacer elements 16 may be provided for aligning the strap edge of the spine on the back cover 42 in a spaced relationship from the dominant fold line 44. The spacers should be sufficient to allow flattening of the strap 20 of the loops formed by the loop-forming elements into a fold 64 that does not overlap the dominant fold 44 of the folder when the front cover 43 is pressed against the back cover 42 (see schematic section illustration of FIG. 8). Put another way, the spacing distance of spacer elements 16 should be approximately equal to the outward distance of the fold 64 of a strap 20 from the strap edge 12 when the strap is flattened. The strap may move further through the receiver on being flattened, and that is a benefit of the locking style illustrated in FIG. 4. (That style permits such movement and allows quick return of the strap to its locking condition when the loop in reformed by simple finger manipulation or turning of bound pages.) The fold line spacer elements 16 might also be called strap edge spacer elements. The fundamental purpose of these spacer elements is simply to measure a distance or space between the dominant fold line 44 and the strap edge 12 of the spine of the loop binder. Simple pointed projections from the strap edge 12 are ideal. No more than two is critically necessary. Another technique for creating a spacer element would be that of marking the straps 20 at a distance slightly outward from the strap edge 12 of the spine so as to identify the spacing distance. Of course, where the loop binder folders of the invention are manufactured by a manufacturer (as distinct from being made by users), there could be no need to employ spacer elements.

Because the holes 32 for receiving the straps at the receiver edge should be quite proximate to the receiver edge 13 of the spine, and because the body section 27 of straps should generally have a length somewhere between about two and three or four times the width of the spine, and because totally perfect flattening of the strap loops into a bend or fold 64 is almost impossible to achieve since there is always a thickness of strap material that resists formation of a perfect fold, the spacer 16 projection from the strap edge 12 should never exceed the width of the spine 11 and indeed will generally not exceed about one-half the width of the spine. Still further, in instances where the body section 27 of the strap is minimal (i.e., toward or about two times the width of the spine), the distance of projection of spacer 16 may be even less, such as no more than about or around one-fifth or possibly one-fourth the width of the spine. Spacers most preferably will range from about 1 to about 3 or maybe 5 mm. Such small spacing allows room for the straps to be folded without overlapping the folder crease (when the strap is pushed further through the receiver on folding) and does not shift the spine so far outward from the dominant crease of a folder as to cause loose-leaf sheets to project beyond the outer edge of it.

Folders in most countries have achieved a certain standardization of size, and punched sheets extending outward from such folders create problems for the user. Thus, for example, in the case of letter-size folders as used popularly for letter-sized sheets in the United States, minimally adequate spacing of the spine from the dominant fold or crease line of a folder is generally preferred so as to avoid having the letter-sized sheets project outwardly from the outer edge 46 of the folder (i.e., the edge opposite the dominant fold line). That consideration puts emphasis on not over-spacing a spine 11 from the dominant fold line 44. Where the desire for effecting flattening of the loops 66 can be sacrificed (i.e., where the thinness of folders for file storage or carrying in a briefcase is not important), the positioning of the strap edge 12 of the spine at a location immediately adjacent the dominant fold line of a folder is possible, and the folder may be folded at an additional fold line spaced from the dominant one so as to allow closure without causing great flattening of the loops 66 formed by the straps 20 of the loop binder.

In different countries, the distance inward from a paper edge where holes are punched for placement in a ring binder may vary but has become more or less standardized, especially where two- or three-ring binders or possibly four- or five-ring binders are the popular sizes. Loop binders for sheets having two through five or possibly six punched holes are all within the most realistic range for practicing the present invention. While extremely wide spines such as those over 5 or 10 cm may have some uses, such extreme widths should for the most part be avoided. On the other hand, spines should always have a width of at least about 0.5 cm and rarely have a width in excess of 3 cm, and generally have a width not in excess of about 2 cm. In the preferred range between about 1 and 2 cm are spine widths that, when measured by reference to the "paper punch distance" (i.e., the paper punch distance being the distance from the edge of punched paper to the center of the punched hole in the paper through which the loop of a looped binder is to be passed), are about equal to that paper punch distance up to about two times that paper punched distance. Spine widths within the range noted contribute nicely to turning of loose-leaf pages held in the loops of a loop binder (when the loops are in their teardrop shape or return back to it on opening a folder and turning pages or are assisted in their return to a teardrop shape by hand pressing or shaping of the loop on opening a folder). Spines narrower than about 1 cm in width, when used, can create small difficulties in terms of turning sheets of paper in a loop binder, but might be used where page turning is infrequent but nevertheless has to be possible. In this regard, where extremely thin widths for the spine are desired, the strap length has to be increased for convenience of page turning and the test for strap length is best measured by considering the over-all length of the material forming the loop of the loop binder. This means that the over-all length of material forming a loop has to be measured from the center of the receiving hole 32 across the spine 11 and down the length of the strap 20 up to the locking structure 25. Another way of stating this point is to explain that the over-all loop length constitutes the length of the body section 27 of the strap 20, the width of the spine 11, and the distance from the receiver edge 13 of the spine 11 to the center of the hole 32 through which the strap 20 passes. That over-all length should never be below three, and preferably should be at least about 3.5 or 4 times up to about six times the paper punch distance aforenoted. Thus a paper having punched holes whose center is about 1 cm from the nearest adjacent edge of the paper will in normal practice need a loop of over-all length from the center of the receiver hole 32 to the locking element 25 on the strap 20 of at least about 3.5 cm (or about 4 cm), up to about 6 cm, for convenient sheet turning in the loop of the binder.

The straps 20 are preferably uniform in width and thickness throughout their entire length except for the niche or notch or other feature for locking, and strap receiver holes preferably have a diameter equal to the width of the strap that is to go through the hole. At first blush, this might suggest a problem in getting the strap through the hole since it is well known that a dowel of ¼ inch diameter cannot be passed through a hole of exactly ¼ inch diameter. There has to be some clearance or slight increase of hole diameter in order to permit the dowel to pass through the hole. Such a clearance is not necessary for the strapreceiving holes of this invention, since a strap of ¼ inch width can easily be pressed through a hole of exactly ¼ inch diameter. What happens as the strap is pressed through such a hole is that the strap is forced into a curvature across its transverse width as it passes through the hole. This is an ideal feature inasmuch as once the locking feature 25 of the strap reaches the hole, the strap snaps into a locked condition, but a condition quite easily altered to a transversely curved condition when yanking the strap either further forward through or backward out of the hole. In metric terms, straps according to the invention should never be less than about 0.2 cm (2 mm) in width or more than about 1 cm or possibly 1.5 cm in width, and generally should be wider in width than in thickness. The most useful straps will vary in width from about 0.4 or 0.5 cm up to about 1 cm, with about 0.6 or 0.7 cm most likely to be a popular width. Hole widths that are measured in the direction parallel to the receiver edge 13 of the spine 11 ideally will match the selected strap width, and although circular holes are preferred, it is possible that oval or other hole shapes (semi-circular, crescent, etc.) may be useful.

Ideally, the spine, straps, and strap receivers are all formed out of the same material and formed as a unitary body. (The possibility of forming the spine and the straps out of different materials and the strap receivers out of yet a third material only increases costs needlessly.) The thickness of the material forming the spine, straps, and body usually should not exceed about 2 mm and preferably not exceed about 1 mm. Ideal thicknesses can be as thin as about 0.25 mm (equivalent to about 10 mils or 0.010 inches) up to about 1 mm (or about 40 mils or 0.040 in.), with the most practical thicknesses within this range lying between about ⅓ of a millimeter to about 9/10 millimeter, and a very practical thickness within this range being about 0.5 or 0.6 mm (about 23 mils or 0.023 in.).

A critical feature is that the straps be pliable, and this can affect the thickness chosen if the material from which the structure is to be formed exponentially increases in stiffness as it is increased in thickness. An ideal material for forming the structure is polyethylene, especially linear polyethylene. However, polypropylene may be employed as well as a multitude of other plastics, including any of a variety of polyolefins and modified polyolefins. Many different plastics may be used. For example, polyethylene terephthalate, polyurethanes, polyvinyl chlorides, and many other different types of plastics may be useful. The plastic may even exhibit rubbery resilience, although that is not a critical, nor is it an especially desirable, feature for the loop structures of the invention. Rubbery materials generally tend to lack the slippery character that non-rubbery plastics exhibit. Thus, plastics as distinct from rubbery materials are desirable from the standpoint of easy sliding of punched sheets as they are turned on loops of the binder. The ideal material for the sheet material of the spine, straps, and strap receivers of the invention is a flat flexible plastic sheet of substantially uniform thickness. Flat plastic sheets (rollered or extruded or molded, etc.) exhibiting relatively slippery exposed surfaces are very useful. At the sheet thicknesses employed for the loops, the plastic sheet should be easily crushable or flattenable or foldable under modest finger pressure or the simple pressure applied as a folder front cover is closed against a folder back cover carrying a new loop binder as taught herein. While resilience for the straps to bounce back into a teardrop loop from a flattened condition is not undesirable, it is not critical, and straps that do not spring back or even completely recover from deformation or folding when the pressure of folding is removed are highly desirable so long as they are pliable and at least slowly recover from flattening or can be encouraged to return to a teardrop shape by simple finger help. Polyolefinic plastics exhibit these characteristics, and flat plastic sheets of economical polyethylene, especially linear polyethylene, are attractive for practicing the invention.

As for the adhesive layer 17, any of a variety that exhibit the necessary and desirable characteristics of adhering strongly to the back surface of the spine (i.e., not delaminating easily so as to cause the spine to be easily separated from the adhesive), as well as to the backing sheet of a folder to which the loop binder of the invention is to be attached, can be useful. Adherence to the spine is the first critical point to assess and those skilled in the art of forming non-delaminating adhesive coatings or layers will appreciate that a multitude of considerations can have a bearing on adhesive selection once a decision has been made as to the particular type of sheeting to be employed for the base structure (i.e., the spine). Reliance on experts is made for that assessment; the essential point made in this disclosure is that an adhesive that does not delaminate is applied either to the back surface of the spine or, in the case of manufacturers equipping a folder with the new loop binder of the invention, on the area of the interior surface of a folder backing where the spine is to be affixed. From the standpoint of this invention, any suitable adhesive for attaching the spine to the interior surface of a folder is satisfactory. While adhesives that are activated by heat or water or solvent can be used, the most preferred are those that are characterized as pressure-sensitive adhesives. Pressure-sensitive adhesives are sometimes referred to as rubber-resin type adhesives that have a fourfold balance of properties consisting of adhesion, cohesion, stretchiness, and elasticity. This balance causes the adhesives to be aggressively and stably tacky and yet frequently capable of being stripped back from a smooth surface to which temporarily applied without delamination, splitting, or offsetting of adhesive. The balance of properties for pressure-sensitive adhesives is exhibited by some polymers, especially acrylic polymers. It appears that companies such as Minnesota Mining and Manufacturing Co. of St. Paul, Minn. have constantly improved the quality of pressure-sensitive adhesives, as well as the ability to cause them to adhere to a variety of substrates including olefins, as by special surface treatments. Sometimes surface treatments or vapor deposits on a plastic will improve the adherence of a pressure-sensitive layer to the surface of the plastic. From the standpoint of loop binders of this invention, it is the combination of adhesive 17 (especially a normally tacky pressure-sensitive adhesive) on or with spine 11 that is the important new inventive feature.

Another aspect of this invention that relies upon expert knowledge developed by others is that of providing an appropriate temporary removable low-adhesion liner 18 for a tacky layer such as a pressure-sensitive adhesive layer. The low-adhesion surface of an easily removable liner may be formed using any of a variety of specially selected low-adhesion material. Polymers of silicone or of tetrafluoroethylene (TEFLON) are examples of low-adhesion materials that may be employed. Again it is emphasized that the particular chemistry of a composition forming a low-adhesion surface for a temporarily, easily removable liner on a pressure-sensitive layer is but a selection of an appropriate liner out of the multitude that have already been heretofore developed. The important feature from the standpoint of this invention is that of the combination of the spine, adhesive, and liner, a combination original to this invention and therefore part of this invention and not coming from any other party.

An inherent feature of this loop-binder invention is that of its safety and ease of use. It is safe to use without incurring pinched skin or fingers as can result from the use of springy metal ring binders. It is easy to use without wrestling with springy metal binders or suffering snags or interlocking of pre-curved springy plastic rings or other types of plastic rings that are non-flattenable and generally quite expensive to manufacture, especially when compared to the extraordinary economy of manufacture for the loop binder teachings of this invention.

To be emphasized is that each loop of the binder is easily flattenable toward the front surface of the spine while simultaneously causing the body section of the strap to be folded at the strap edge side or at a location spaced outward from the strap edge of the spine and while simultaneously also maintaining the back surface of the lead end of the strap in a facing relationship to the back surface of the receiver. This flattening may optionally in some instances be accomplished without causing disengagement of the locking structure from its receiver.

The several characteristics of loops formed according to the invention give benefits impossible to achieve by standard ring binders. The flattenable or collapsible feature alone, combined with the ability of the loop to reassume a teardrop shape (although the resumption may be quite slow) facilitates the formation of loop binder folders that can be exceedingly thin in total thickness, entirely free of clumsy structures (such as spirals or fixedly arched multiple rings mounted on a backbone), and easily stored in a minimum of space in a file cabinet or brief case or other device without suffering interlocking of adjacent folders and without obstructing easy removal or separation of one folder from another.

Noteworthy is the fact that the straps are ideally connected directly to the strap edge of the spine. Further, there is no body of material extending from the strap edge of the spine outwardly around the ends of the straps. No body of material extends outward from the strap edge of the spine to the very ends of the straps and in parallel alignment with the straps. Simplicity of structure is paramount for the ideal binders of the invention.

An illustrative loop binder having excellent properties has been made by die cutting a sheet of linear polyethylene of about 23 mils in thickness so as to form a spine of about ½ in. width and about 11 in. in length, with three pairs of loop-forming elements on the spine. The straps were ¼ in. wide and about 2 in. in length, with notches about 1¼ in. out from the strap edge of the spine. The strap-receiver holes were ¼ in. in diameter and centered about ⅜ in. out from the receiver edge (leaving about ⅛ in. between the inner edge of the hole and the receiver edge of the spine). The pressure-sensitive adhesive and low-adhesion removable liner were taken from a purchased combination available on the market, namely a roll of Minnesota Mining and Manufacturing Company's double-faced pressure-sensitive adhesive tape No. 926 having a ½ in. width. Its rolled layers of adhesive were separated by a silicone-surfaced removable release liner, which was used as the low-adhesive liner of this invention.

Those skilled in the art will readily recognize that this invention may be embodied in still other specific forms than illustrated without departing from the spirit or essential characteristics of it. The illustrated embodiments are therefore to be considered in all respects illustrative and not restrictive, the scope of the invention being indicated by the appended claims rather than the foregoing description, and all variations that come within the meaning and range of equivalency of the claims are therefore intended to be embraced thereby.

That which is claimed is:

1. A pliable, readily flattenable loop binder for retaining loose-leaf sheets, comprising:

(i) a mounting strip having an elongated spine with opposing longitudinal edges and front and back surfaces, said mounting strip additionally having an adhesive layer on the back surface of said spine for adhesively mounting said strip on the inside surface of a folder to form a loop binder folder for loose-leaf sheets, and (ii) paired transversely aligned loop-forming elements projecting outward from said opposing longitudinal edges of said spine, said loop-forming elements projecting outward from one said longitudinal edge being pliable and readily bendable straps having a back surface that extends from the back surface of said spine, and said loop-forming elements projecting outward from said other longitudinal edge being strap receivers having a back surface that extends from the back surface of said spine, said loop-forming elements being such that the strap of a pair is capable of being drawn over said front surface of said spine and threaded through the receiver of said pair to exit at the back surface of the receiver so that the back surface of the strap faces the back surface of the receiver, each loop so formed by a said pair of loop-forming elements being characterized by being tear drop in contour and by being flattenable toward the front surface of said spine with a single folded bend in said strap while also maintaining the back surface of the strap in said facing relationship to the back surface of the receiver, said loop-forming elements being such that the strap of a pair can easily be unthreaded and rethreaded through the receiver of said pair for the addition or subtraction of loose-leaf sheets even when said mounting strip is adhesively mounted on the inside surface of a folder.

2. The binder of claim 1 wherein said adhesive layer comprises a normally tacky and pressure-sensitive adhesive.

3. The binder of claim 2 additionally comprising a low-adhesion protective temporary removable liner on the pressure-sensitive adhesive layer.

4. The binder of claim 1 wherein said straps have one end as a connected end at said one longitudinal edge and an opposite end as a free end, and wherein said binder additionally comprises a locking structure called a dominant locking structure on said straps at a location more proximate to said free end than to said connected end thereof, each said dominant locking structure being spaced equally distant from said one longitudinal edge, said dominant locking structure on the strap of a pair of said loop-forming elements being engageable with said strap receiver of the pair to resist movement of the strap in either direction through the receiver.

5. The binder of claim 4 wherein each said locking structure comprises a notch.

6. The binder of claim 4 additionally comprising a subordinate locking structure on said straps, each said subordinate locking structure on a strap being at a uniform distance from the connected end of the strap.

7. The binder of claim 1 wherein said straps are substantially uniform in thickness and width throughout their length except for any optional locking structures that may be formed on said straps, and wherein said strap receivers comprise a hole having a dimension parallel to said spine substantially equal to the width of said straps.

8. The binder of claim 7 wherein said strap receiver holes comprise circular holes.

9. The binder of claim 1 additionally comprising spacer elements for aligning said spine in a spaced relationship from the dominant fold line of a folder.

10. The binder of claim 1 in combination with a folder having a front cover and a back cover extending from a dominant fold line, and having said binder fixed on said back cover of the folder at a location parallel to and spaced from said dominant fold line.

11. The binder of claim 1 wherein said spine, straps, and strap receivers are formed of plastic.

12. A pliable, readily flattenable loop binder for retaining loose-leaf sheets, comprising:

(i) a mounting strip having an elongated plastic spine with opposing longitudinal edges and front and back surfaces, said opposing longitudinal edges defining the transverse width of said spine, one of said longitudinal edges being a strap edge and the other being a receiver edge, (ii) paired transversely aligned loop-forming elements projecting outward from said opposing longitudinal edges of said spine, said loop-forming elements projecting outward from said strap edge being pliable and readily bendable straps, and said loop-forming elements projecting outward from said receiver edge being flexible strap receivers, said straps having one end as a connected end at said strap edge and an opposite end as a free end and having a front surface extending from the front surface of said spine and a back surface extending from the back surface of said spine, a locking structure on said straps at a location more proximate to said free end than to said connected end thereof, each said locking structure being spaced from said strap edge of said spine a uniform distance between about two and four times the transverse width of said spine, the portion of said strap between its locking structure and its free end being the strap lead end and the portion of said strap between its locking structure and its connected end being the strap body section, said strap receivers having a front surface extending from the front surface of said spine and a back surface extending from the back surface of said spine, said loop-forming elements of each said pair being such that the strap thereof is capable of having its free end drawn over said front surface of said transverse width of said spine and threaded through the receiver thereof to exit at the back surface of the receiver a sufficient extent to cause the locking structure of the strap to engage the receiver and also cause the lead end of the strap to project outwardly from the receiver edge with the back surface of the lead end of the strap facing the back surface of the receiver, each loop so formed by a said pair of loop-forming elements being characterized by being teardrop in contour and by being flattenable toward the front surface of said spine while simultaneously causing the body section of the strap to be folded at a location outward from said strap edge of said spine and also maintaining the back surface of the lead end of the strap in said facing relationship to the back surface of the receiver, and (iii) an adhesive on the back surface of said spine for adhesively mounting said mounting strip on an inside surface of a folder to form a loop binder folder for loose-leaf sheets, said loop-forming elements being such that the strap of a pair can easily be unthreaded and rethreaded through the receiver of said pair for the addition or subtraction of loose-leaf sheets even when said mounting strip is adhesively mounted on the inside surface of a folder.

13. The binder of claim 12 additionally comprising spacer elements for aligning said strap edge of said spine in a spaced relationship from the dominant fold line of a folder selected for conversion to a loop binder folder by adhesive attachment of said binder in said folder.

14. The binder of claim 12 attached within a folder having a dominant fold line and a front and back cover hinged together at said dominant fold line, said binder additionally including spacer elements for aligning said strap edge of said spine in a spaced relationship from said dominant fold line of said folder sufficiently to allow the strap of the loops formed by said loop-forming elements to be folded so that the strap fold will not overlap said dominant fold line.

15. A loop binder folder for retaining loose-leaf sheets, comprising:

(a) a folder having a dominant fold line, a back cover extending on one side from said fold line and a front cover extending from the other side of said fold line, and (b) a pliable, readily flattenable loop binder, said loop binder including:

(i) a mounting strip having an elongated spine with opposing longitudinal edges and front and back surfaces, said opposing longitudinal edges defining the transverse width of said spine, one of said longitudinal edges being a strap edge and the other being a receiver edge, and (ii) paired transversely aligned loop-forming elements projecting outward from said opposing longitudinal edges of said spine, said loop-forming elements projecting outward from said strap edge being pliable and readily bendable straps, and said loop-forming elements projecting outward from said receiver edge being flexible strap receivers, said straps having one end as a connected end at said strap edge and an opposite end as a free end and having a front surface extending from the front surface of said spine and a back surface extending from the back surface of said spine, a locking structure on said straps at a location more approximate to said free end than to said connected end thereof, each said locking structure being spaced from said strap edge of said spine a uniform distance between about two and four times the transverse width of said spine, the portion of said strap between its locking structure and its free end being the strap lead end and the portion of said strap between its locking structure and its connected end being the strap body section, said strap receivers having a front surface extending from the front surface of said spine and a back surface extending from the back surface of said spine, said loop-forming elements of each said pair being such that the strap thereof is capable of having its free end drawn over said front surface of said transverse width of said spine and threaded through the receiver thereof to exit at the back surface of the receiver a sufficient extent to cause the locking structure of the strap to engage the receiver and also cause the lead end of the strap to project outwardly from the receiver edge with the back surface of the lead end of the strap facing the back surface of the receiver, each loop so formed by a said pair of loop-forming elements being characterized by being teardrop in contour and by being flattenable toward the front surface of said spine while simultaneously causing the body section of the strap to be folded at a location outward from said strap edge of said spine and also maintaining the back surface of the lead end of the strap in said facing relationship to the back surface of the receiver, and (c) said loop binder being adhesively attached to said back cover of said folder with said spine parallel to and in spaced relationship from said dominant fold line just sufficiently to allow the fold of flattened straps to substantially entirely not overlap said dominant fold line.

16. The loop binder folder of claim 15 wherein said loop binder additionally comprises spacer elements for aligning said strap edge of said spine in a spaced relationship from the dominant fold line of said folder.

17. A method for binding loose-leaf sheets in a pliable and readily flattenable loop binder having a mounting strip with an elongated spine and opposing longitudinal edges and front and back surfaces, and having paired transversely aligned loop-forming elements projecting outwardly from said opposing longitudinal edges of said spine, the loop-forming elements projecting outwardly from one said longitudinal edge being pliable and readily bendable straps having a back surface that extends from the back surface of said spine, and said loop-forming elements projecting outward from the other longitudinal edge being strap receivers having a back surface that extends from the back surface of said spine, said method comprising:

(i) adhesively mounting the back surface of said mounting strip on an interior surface of a file folder, (ii) threading the straps of said loop-forming elements through punched holes proximate to the edge of loose-leaf sheets, and (iii) threading said straps through the strap receivers thereof in a manner such that said straps can easily be unthreaded and rethreaded through said receivers for the addition or subtraction of loose-leaf sheets in said binder.

18. The method of claim 17 wherein said straps are equipped with locking structures.

19. The method of claim 17 additionally comprising locking said straps in said strap receiver in a manner resisting but not preventing movement of said straps either forwardly further through or backwardly out of said strap receivers.

* * * * *